US010907913B2

(12) United States Patent
Stramka et al.

(10) Patent No.: US 10,907,913 B2
(45) Date of Patent: Feb. 2, 2021

(54) DEVICE FOR THE CLEANING OF FLUE GAS TUBES OF A BOILER PLANT WITH A CLEANING HOSE, A HOSE STORE AND A HOSE GUIDE

(71) Applicant: Martin GmbH fuer Umwelt- und Energietechnik, Munich (DE)

(72) Inventors: Claudia Stramka, Gilching (DE); Ralf Draeger, Dachau (DE)

(73) Assignee: Martin GmbH fuer Umwelt- und Energietechnik, Munich (DE)

( * ) Notice: Subject to any disclaimer, the term of this patent is extended or adjusted under 35 U.S.C. 154(b) by 262 days.

(21) Appl. No.: 15/124,421

(22) PCT Filed: Mar. 23, 2015

(86) PCT No.: PCT/DE2015/000132

§ 371 (c)(1),
(2) Date: Sep. 8, 2016

(87) PCT Pub. No.: WO2015/149733

PCT Pub. Date: Oct. 8, 2015

(65) Prior Publication Data

US 2017/0010061 A1 Jan. 12, 2017

(30) Foreign Application Priority Data

Apr. 1, 2014 (DE) ..... 10 2014 004 639

(51) Int. Cl.
*F28G 1/16* (2006.01)
*F28G 15/04* (2006.01)
(Continued)

(52) U.S. Cl.
CPC ..... *F28G 1/163* (2013.01); *F22B 37/48* (2013.01); *F23J 3/026* (2013.01); *F28G 15/02* (2013.01); *F28G 15/04* (2013.01); *F28G 15/08* (2013.01)

(58) Field of Classification Search
CPC ..... F28G 1/163; F28G 15/02; F28G 15/08; F28G 15/04; F23J 3/026; F22B 37/48
(Continued)

(56) References Cited

U.S. PATENT DOCUMENTS 2,864,587 A 12/1958 Broman
3,531,059 A * 9/1970 Walker ..... A62C 33/02 15/104.33
(Continued)

FOREIGN PATENT DOCUMENTS

DE 20 2008 011514 U1 11/2008
DE 10 2010 051657 A1 5/2012
(Continued)

OTHER PUBLICATIONS

International Search Report of PCT/DE2015/000132, dated Aug. 28, 2015.
(Continued)

*Primary Examiner* — Steven B McAllister
*Assistant Examiner* — Benjamin W Johnson
(74) *Attorney, Agent, or Firm* — Collard & Roe, P.C.

(57) ABSTRACT

A cleaning hose conveying module is proposed for the simple and quick cleaning of flue gas tubes, with which the cleaning hose can be conveyed from a hose store into a hose guide. A hose cleaning means is formed by a rinsing and drying unit for a hose after its withdrawal from the flue gas tube.

14 Claims, 4 Drawing Sheets

Figure 1:
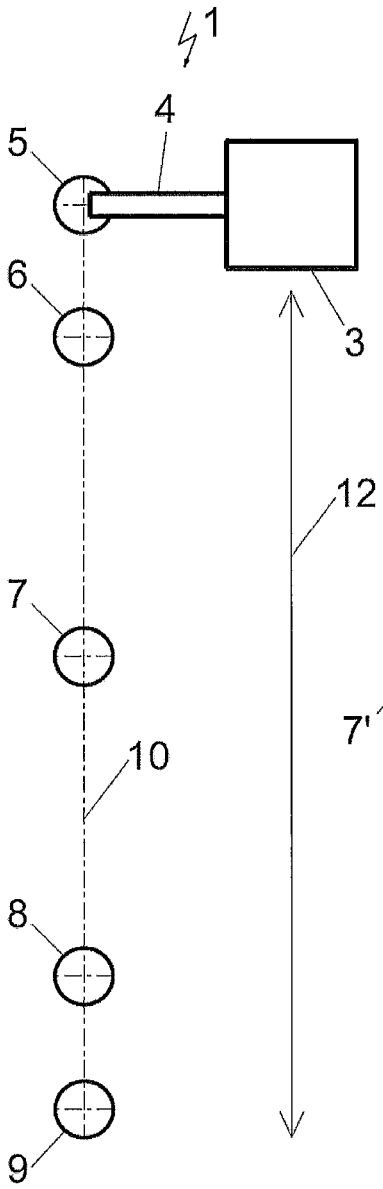

(51) Int. Cl.

| | |
|---|---|
| ***F28G 15/02*** | (2006.01) |
| ***F28G 15/08*** | (2006.01) |
| ***F23J 3/02*** | (2006.01) |
| ***F22B 37/48*** | (2006.01) |

(58) Field of Classification Search
USPC ..... 122/390, 392, 405, 379; 15/302, 300.1, 15/306.1, 312.2, 314, 316.1
See application file for complete search history.

(56) References Cited

U.S. PATENT DOCUMENTS

| | | | | |
|---|---|---|---|---|
| 4,367,790 | A * | 1/1983 | Draeger | F28G 15/04 165/11.1 |
| 4,743,175 | A * | 5/1988 | Gilmore | B65H 51/14 166/77.2 |
| 6,003,194 | A * | 12/1999 | Eckroth | A62C 33/02 15/302 |
| 2004/0069331 | A1 * | 4/2004 | Garman | B08B 9/0433 134/167 C |
| 2007/0163629 | A1 | 7/2007 | Bruendermann | |
| 2013/0312672 | A1 | 11/2013 | Tirkschleit et al. | |

FOREIGN PATENT DOCUMENTS

| | | | |
|---|---|---|---|
| DE | 10 2011 076 585 | A1 | 11/2012 |
| EP | 1918671 | A1 * | 10/2007 |
| EP | 1 918 671 | A1 | 5/2008 |
| GB | 753 851 | A | 8/1956 |
| JP | 53-043214 | U1 | 4/1978 |
| JP | 2014-500943 | A | 1/2014 |
| WO | 2005/024333 | A1 | 3/2005 |

OTHER PUBLICATIONS

German Search Report in DE 10 2014 004 6397, dated Aug. 11, 2014, with English translation of relevant parts.
Japanese Office Action in JP 2016-554726, dated Jul. 24, 2018.
English Translation of the International Preliminary Report on Patentability and Written Opinion of the International Searching Authority dated Oct. 4, 2016, in PCT/DE2015/00132.
Clyde Bergemann GmbH proposal for Online-Cleaning-System type SCS 400-2/ES/A for Cornwall WTE Plant, dated Feb. 23, 2011.

* cited by examiner

DEVICE FOR THE CLEANING OF FLUE GAS TUBES OF A BOILER PLANT WITH A CLEANING HOSE, A HOSE STORE AND A HOSE GUIDE

CROSS REFERENCE TO RELATED APPLICATIONS

This application is the National Stage of PCT/DE2015/000132 filed on Mar. 23, 2015, which claims priority under 35 U.S.C. § 119 of German Application No. 10 2014 004 639.7 filed on Apr. 1, 2014, the disclosure of which is incorporated by reference. The international application under PCT article 21(2) was not published in English.

The invention relates to a device for the cleaning of flue gas tubes of a boiler plant with a cleaning hose, which can be inserted through an opening in a flue gas tube, with a hose store for providing the cleaning hose outside the flue gas tube, and a hose guide, through which the cleaning hose can be inserted into the flue gas tube.

Moreover the invention relates to a method for the cleaning of flue gas tubes of a boiler plant with a cleaning hose, with which the cleaning hose is unrolled from a hose store and inserted through an opening into a flue gas tube.

In particular the invention relates to a method for the cleaning of the empty passes of a boiler. The empty passes or so-called radiation passes are realised as a gas-tight welded membrane wall structure and in boiler plants are used as heat exchange surfaces. In operation some of the fly ash transported in the flue gas clings to the membrane walls of the empty passes and can, over time, develop into hard cakings. As a result the exchange of heat via the membrane walls is reduced, which leads to a rise in flue gas temperature and a resulting reduction in efficiency of such a thermal power plant. Since the salts present in the adhering dirt have a corrosive reaction to the steel, cleaning of the membrane walls also represents increased protection against corrosion.

Due to the regular cleaning of the soiled membrane walls the flue gas temperature in radiation passes/prior to the entry into downstream convective heat surfaces is held at an acceptable value. This leads to an increase in availability of the overall plant.

The cleaning hose is unrolled manually or in a motor-driven manner from a reel-like hose store and is passed to an opening in the roof of the boiler plant. There the hose is inserted into an opening through which the hose is passed to the flue gas tube. This is time-consuming and laborious.

Therefore the invention is based on the requirement to further develop a generic device in such a way as to make it easier for the cleaning hose to be used for cleaning different flue gas tubes.

This device-related requirement is met by a generic device, which comprises a cleaning hose conveying module, with which the cleaning hose can be pushed from the hose store into the hose guide, which extends between the roof of the boiler and a platform.

If the hose guide comprises a vertical and a horizontal direction component, a hose in the hose guide cannot only be pushed vertically downwards into the boiler, but the entries of the hose guides can be arranged on a line or an arc, whilst the openings in the boiler roof are not arranged on a line or an arc.

Pushing the cleaning hose makes it possible to use arcs greater than 30° with a bending radius of at least 500 mm for the hose guide. It is advantageous if the hose guide comprises arcs of less than 45° and preferably of even less than 40°. This allows the use of more acute angles than has been possible up to now.

It is particularly advantageous if the hose reel is arranged horizontally. This makes it possible to arrange the hose store above the platform, even if space is tight.

The cleaning hose conveying module makes it possible to pull the cleaning hose off the hose reel and insert it into the hose guide at a defined constant speed, so that the hose can be automatically conveyed from the hose store to the flue gas tube.

It is advantageous if the cleaning hose conveying module is arranged directly in front of the hose guide. This makes it possible to push the flexible cleaning hose into the hose guide by means of the cleaning hose conveying module, thus allowing the hose to be conveyed to the flue gas tube, even through a long pipe-shaped hose guide. In particular the hose can thus be pushed into the hose guide and finds its way through the hose guide to the opening and into the flue gas tube in a guided manner. This is of advantage, in particular if the hose guides are long.

An advantageous variant makes provision for the cleaning hose conveying module to comprise contact rollers which are pre-tensioned by means of a spring force. This allows the cleaning hose to be carefully and effectively conveyed.

Depending on whether the hose still lies completely on the reel of the hose store or whether it has already been unrolled to a large extent, does a pull on the hose at a defined force lead to different unrolling speeds. It is therefore proposed to use a feed drive for controlling the speed of the cleaning hose driven by the cleaning hose conveying module.

In order to reach a number of entrances of hose guides solely by swivelling an arm on which the cleaning hose conveying module is mounted, it is proposed that the majority of entrances of the hose guides are arranged on a circle line. This makes it possible using a centrally positioned unit, to convey the hose via a radially extending supporting arm to a number of hose guides, which lead to different flue gas tribes or different locations on the ceiling of flue gas tubes.

One constructive development provides for a cleaning hose positioning means, which guides the cleaning hose on a defined route to a number of hose guides. This makes it possible, using the cleaning hose positioning means, to take the cleaning hose to a hose guide and to stop there so that the hose can be unwound from the hose store and be inserted into the hose guide.

The route of the cleaning hose positioning means preferably lies on a circle line. But it is also possible to design the cleaning hose positioning means in such a way that it lies on a straight line. To this end the cleaning hose positioning means comprises a cleaning hose supporting arm, which can be moved or swivelled laterally in order to position the cleaning hose along a number of hose guides arranged in one line.

The cleaning hose positioning means is thus essential to the invention, independently of the previously mentioned features of the invention and in particular without cleaning hose conveying module.

It is advantageous if the device comprises a hose cleaning means with pneumatic blasting of the hose. By blowing compressed air onto the cleaning hose it is possible to remove dust particles from the cleaning hose or to dry moisture stemming from wet cleaning of the hose.

Because the combination of pneumatic dry cleaning and wet cleaning is particularly advantageous, it is proposed that the hose cleaning means first cleans the hose by spraying it with water and then blasts is with air in order to dry it and post-clean it.

An advantageous variant provides for the hose cleaning means to be attached to the cleaning hose conveying module and to be connectable to the hose guide. This makes it possible to provide a single hose cleaning means on the cleaning hose conveying module and to clean the cleaning hose with the same hose cleaning means, when the cleaning hose is withdrawn from the different flue gas tubes.

The hose cleaning means also is essential to the invention, independently of the previously mentioned features of the cleaning hose positioning means and the cleaning hose conveying module.

The requirement, on which the invention is based, is also met by a method for the cleaning of flue gas tubes of a boiler plant with a cleaning hose, wherein the cleaning hose is unrolled from a hose store and inserted through an opening into a flue gas tube, wherein the cleaning hose, using a cleaning hose conveying module, is pushed from the hose store through a pipe-shaped hose guide into the opening.

This makes it possible to guide the cleaning hose using a cleaning hose conveying module over longer stretches in the pipe-shaped hose guide across vertical, oblique or even almost horizontal stretches to an opening in a fine gas tube. In this case, a gradient of less than 20° means almost horizontal relative to the horizontal. Also, pushing the hose through a pipe-shaped hose guide makes it possible, to convey the hose, even in areas where access is difficult, on a defined route from the hose store to the flue gas tube. Moving the hose and cleaning the hose can be carried out fully automatically.

It is advantageous, in particular when the cleaning hose has an outlet for liquids, if the pipe-shaped hose guide is rinsed with a gliding agent, before, while or after the cleaning hose is pushed into the hose guide. In the simplest case this gliding agent is water. However, the gliding properties of water can be increased by surfactants or other chemicals, or alternatively hydrophobic substances may be used.

Figure 2:
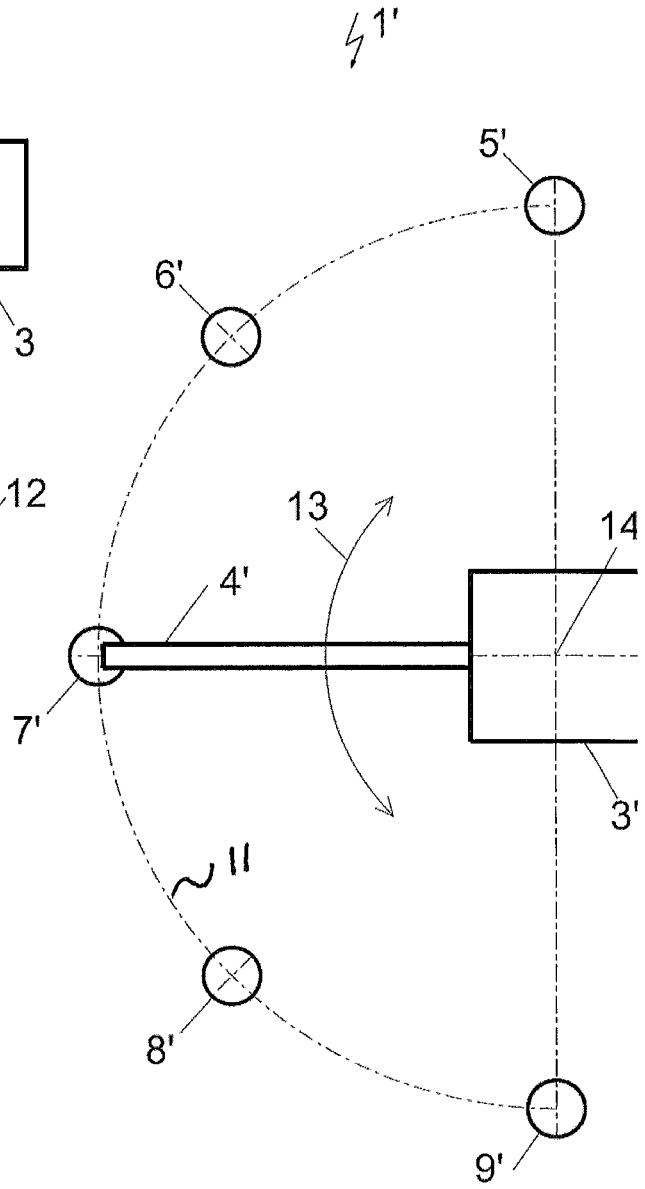
Figure 3:
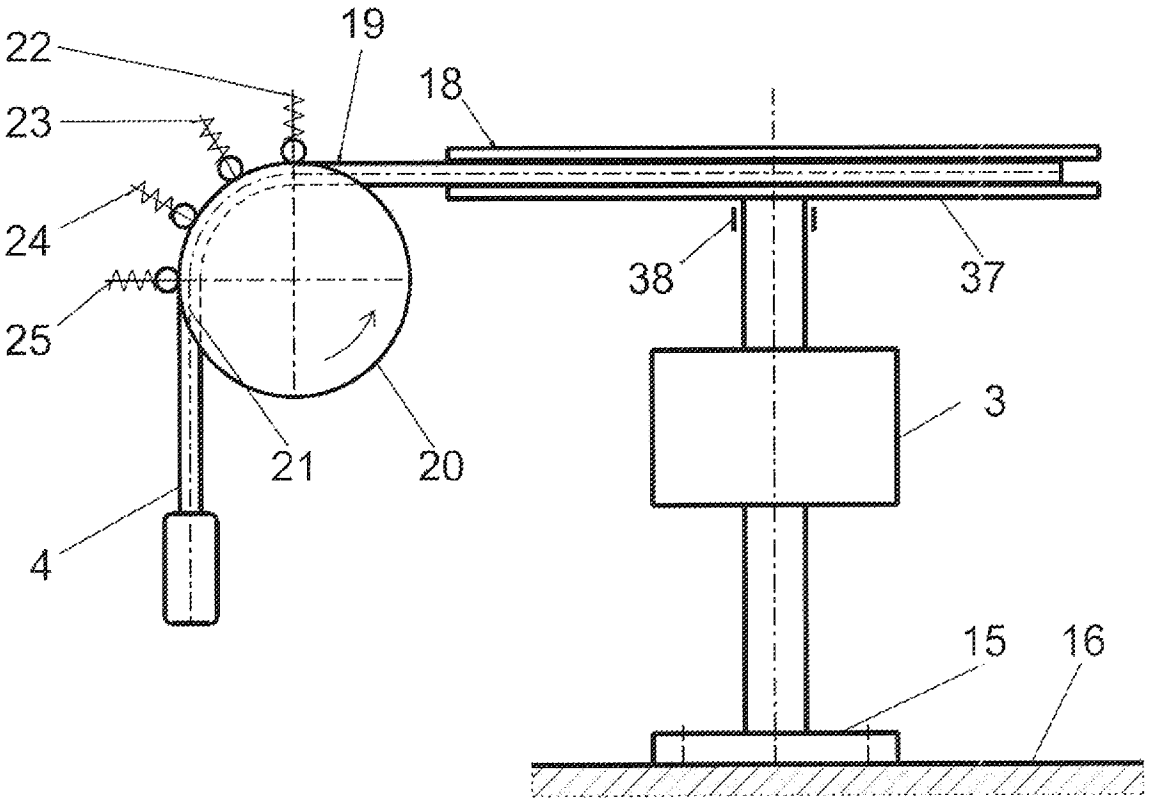
Figure 4:
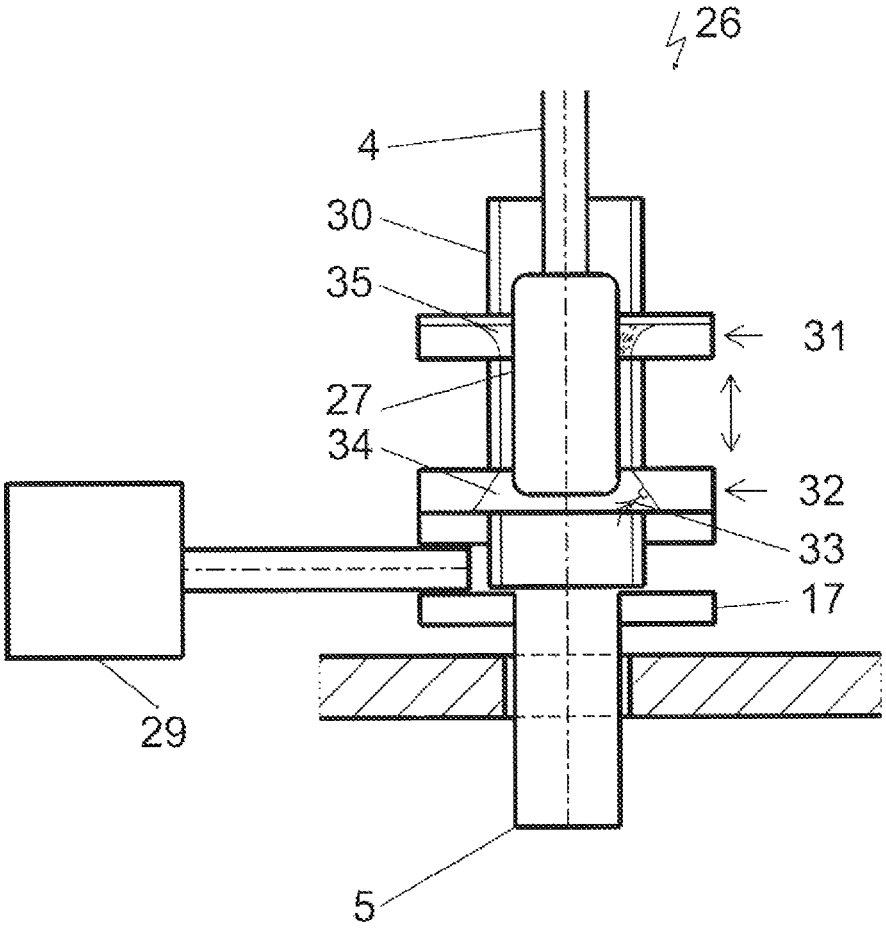
Figure 5:
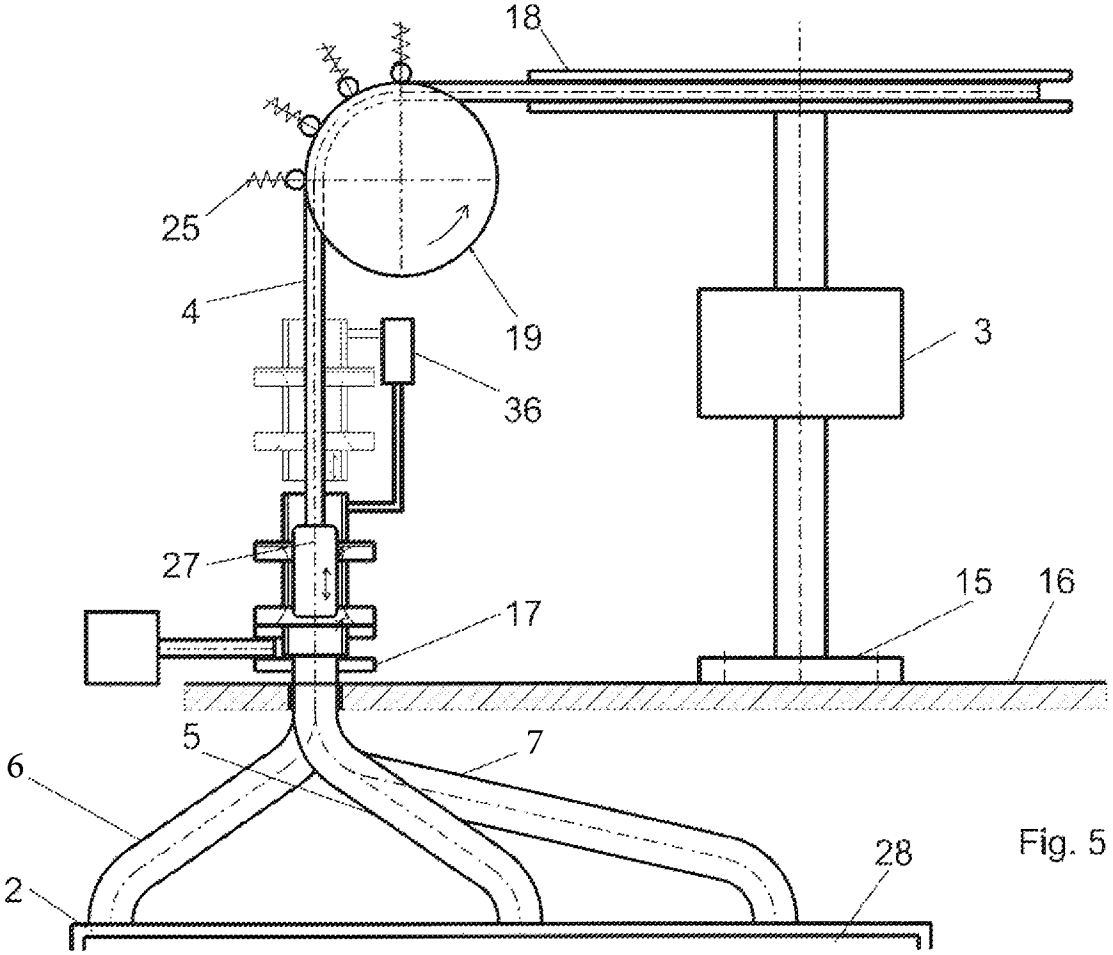

A preferred exemplary embodiment of a device according to the invention is shown in the drawing and will now be explained in detail, in which FIG. 1 shows a schematic top view of a laterally movable cleaning hose positioning means and a number of entrances of hose guides, FIG. 2 shows a top view of a swivelling cleaning hose positioning means with a number of entrances of hose guides arranged on a circle line, FIG. 3 shows a schematic side view of a cleaning hose positioning means with cleaning hose conveying module, FIG. 4 shows a cleaning hose cleaning means and FIG. 5 shows a partially cross-sectional lateral view of the entire plant.

FIGS. 1 and 2 schematically show, how with a device 1 for the cleaning of flue gas tubes of a boiler plant 2 a cleaning hose positioning means 3 guides a cleaning hose 4 to a number of hose guides 5, 6, 7, 8, 9 or 5', 6', 7', 8', 9'. The hose guides 5 to 9 are arranged on a straight line 10, while the hose guides 5' to 9' are arranged on a circle line 11.

The cleaning hose positioning means 3 can be moved along the direction of arrow 12 on a straight line, in order to guide the cleaning hose 4 to the hose guides 5 to 9. The cleaning hose positioning means 3' however may be swivelled along arrow 13 about a point 14, in order to guide the cleaning hose 4' to the hose guides 5' to 9'.

FIG. 3 shows the cleaning hose positioning means 3, which stands on a platform 16 with a base 15. For a linear arrangement the base is connected to a kind of rail system so that the cleaning hose positioning means 3 moves in one axis. In case of a semi-circular arrangement of the connection pieces 17 of the hose guides 5' to 9' this base 15 is rotatably mounted. Rotation of the cleaning hose positioning means 3' is effected via a drive motor flanged onto the frame, until the position above the desired connection piece 17 has been reached.

The cleaning hose positioning means 3, 3' has a hose reel 37 arranged on it, which serves as a hose store 18, and the cleaning hose 4 is guided by means of a cleaning hose conveying module 19 to a hose guide 5 to 9.

In order to prevent the hose driven by the cleaning hose conveying module 19 and unrolled from the hose reel 37, from bending prior to entering the hose guide 5 to 9, the cleaning hose conveying module 19 is arranged directly in front of the hose guide.

The cleaning hose conveying module 19 comprises a feed roller 20 with a circumferential groove 21, in which the hose 4 is guided. The hose 4 can be retained in the groove 21 so that when the roller 20 is rotating, a circumferential force of the roller 20 is transferred to the hose 4. It is advantageous if a number of contact rollers 22 to 25 press the hose into the groove 21.

FIG. 4 shows a hose cleaning means 26. A nozzle 27 is arranged at the front end of the hose 4, which can be pushed through the hose cleaning means 26 and through the connection piece 17 into the hose guide 5. The nozzle 27 then gets into the boiler plant 2 and from there into the flue gas tube 28 for the cleaning of heat exchange surfaces and membrane walls in there.

During insertion and withdrawal of the nozzle 27 the hose 4 comes into contact with flue gases. This has the effect that the cleaning hose 4 with its protective outer envelope consisting of a typical metal fabric transports a considerable amount of fly ash to the outside during withdrawal from the interior of the boiler. This may lead to contamination on the slide 29, the connection piece 17 and the hose reel 37 of the hose store 18. The cleaning hose conveying module 19 is also adversely affected by this contamination. Therefore the hose cleaning means 26 is used for cleaning the hose 4 and, as required, also the nozzle 27.

The hose cleaning means 26 is a pipe-shaped element serving as rinsing pipe 30, which has a gas inlet 31 and a liquid inlet 32 arranged on it. The gas inlet 31 is in communication with a pressurised gas line (not shown), whilst the liquid inlet 32 is in communication with a cleaning liquid line such as a service water line (not shown).

During withdrawal of the soiled hose 4 from the hose guide 5 the hose 4 is initially sprayed with cleaning liquid via nozzles 33 and subsequently dried by means of pneumatic blasting. Every part of the hose 4, during withdrawal of the same, is initially guided past a unit 34 spraying the hose with a liquid, and thereafter it is guided past a pneumatic blast unit 35, whereafter the hose leaves the rinsing pipe 30 in a cleaned state.

In order to insert the hose 4 accurately into the cleaning means 26, a stroke cylinder unit 36 is provided, which is arranged between the cleaning means 26 and the cleaning hose conveying module 19.

So as to ensure that only one hose cleaning means 26 is required for many connection pieces 17 of hose guides 5 to 9, the hose cleaning means 26 is attached to the cleaning hose conveying module 19.

When using the device 1 for the cleaning of flue gas tubes 28, the cleaning module is positioned with a first drive motor of the cleaning hose positioning means 3 above a connection piece 17 of a hose guide 5. A second motor is provided for winding and unwinding of the hose. Using two couplings either the feed roller 20 (for lowering the hose 4) or the hose reel 37 of the hose store 18 (for withdrawing the hose 4) is connected to the drive. In order to prevent the hose from unwinding on its own, the hose reel 37 is held in position via a brake 38.

When the hose cleaning means 26 is positioned over the desired connection piece 17 by a drive motor arranged on the frame of the hose positioning means 3, the hose cleaning means 26 is lowered into the connection piece 17 by means of a pneumatic cylinder 36 through a slide 29. The hydraulic spraying unit 34 and the pneumatic blast unit 35 act as a rinsing and drying unit. Due to their positioning in a funnel (not shown) of the connection piece 17 the rotational movement of the cleaning hose positioning means 3 is sufficiently arrested. An additional fixing in this position is not necessary. This leads to the creation of a practically closed system, which can reduce the outflow of flue gas due to e.g. deflagrations.

By closing a first coupling, a pulley wheel is then connected to a drive shaft, and using the integrated cleaning hose conveying module 19 the hose 4 is pushed with its nozzle 27 into the hose guide 5. To this end the spring-loaded contact rollers 22 to 25 press the hose 4 into the groove 21 of the feed roller 20, so that, due to the frictional connection with the feed roller, this is pulled off the hose reel 37. The feed roller 20 is driven by a drive shaft via the first coupling, a toothed belt and an angle gear. The prerequisite is that both the second coupling and the brake are open so that the hose reel is able to rotate freely.

The cleaning hose conveying module 19 has the advantage that the hose 4 can be inserted into a hose guide 5 either vertically or horizontally. Moreover, due to the use of the cleaning hose conveying module, arcs of more than 30° with a radian measure of at least 400 to 500 mm can be employed so that constructional bottlenecks or narrow spaces in the area between the boiler roof of the boiler 2 and the platform 16, where the hose guides are arranged, do not cause any problems.

When the hose 4 is to be withdrawn, a first coupling is opened, so that the feed roller 20 can rotate freely. At this point the hose reel 37 is connected to the drive shaft via the second coupling. When the hose 4 has been withdrawn completely from the rinsing pipe of the hose guide 5, the brake 38 is closed so that the nozzle 27 cannot drop. The second coupling is then opened again.

Finally the hose cleaning means 26 is pulled out of the connection piece 17. The cleaning hose positioning means 3 can now either remain in this position or be moved to the next connection piece 17 of another hose guide 6. It is advantageous if the cleaning hose positioning means 3, after cleaning is finished, is moved to a defined parking position, which is at a certain connection piece usually located on the outside or in an area outside the connection pieces.

The invention claimed is:

1. A device for the cleaning of flue gas passes between heat exchanger tubes of a boiler plant comprising:

a cleaning hose, which can be inserted through an entrance in a flue gas pass, a hose store, for providing the cleaning hose outside the flue gas pass, a plurality of hose guides, configured to allow insertion of the cleaning hose into the flue gas pass, each of the plurality of hose guides extending from a roof of the boiler plant to a platform, each of the plurality of hose guides comprising, between the roof of the boiler plant and the platform, a first arc of larger than 30° and a second arc of larger than 30°, and a cleaning hose conveying module, with which the cleaning hose can be pushed from the hose store into a selected hose guide of the plurality of hose guides.

2. The device according to claim 1, wherein the cleaning hose conveying module is arranged above the plurality of hose guides.

3. The device according to claim 1, wherein each hose guide comprises a vertical and a horizontal direction component, in order to guide the cleaning hose over oblique stretches to an opening in a flue gas pass.

4. The device according to claim 1, wherein the first arc of each hose guide includes a bending radius of at least 500 mm.

5. The device according to claim 1, further comprising a hose reel that is arranged horizontally.

6. The device according to claim 1, wherein the cleaning hose conveying module comprises contact rollers pre-tensioned via a spring force.

7. The device according to claim 1, wherein a speed of the cleaning hose driven by the cleaning hose conveying module is controlled via a feed drive.

8. The device according to claim 1, further comprising a cleaning hose positioner, which guides the cleaning hose on a defined route to a number of hose guides.

9. The device according to claim 8, wherein the defined route follows a circle line.

10. The device according to claim 8, wherein the defined route follows a straight line.

11. The device according to claim 1, further comprising a hose cleaner with a pneumatic blast unit and a spraying unit having nozzles which spray a cleaning fluid onto the cleaning hose, wherein the hose cleaner is located between the platform and the cleaning hose conveyor module, and wherein the hose cleaner is arranged in such a way that when the cleaning hose is pulled out from a hose guide of the plurality of hose guides, the cleaning hose is first sprayed with the cleaning fluid via the nozzles and is then dried using the pneumatic blasting unit.

12. The device according to claim 11, wherein the hose cleaner is attached to the cleaning hose conveying module and is connectable to the hose guide of the plurality of hose guides.

13. A method for cleaning of flue gas passes between heat exchanger tubes of a boiler plant with a cleaning hose, wherein the cleaning hose is unrolled from a hose store and inserted through an opening into a flue gas pass, wherein the cleaning hose is pushed using a cleaning hose conveying module from the hose store through a pipe-shaped hose guide into the opening, wherein a hose cleaner with a pneumatic blast unit and a spraying unit having nozzles which spray a cleaning fluid onto the cleaning hose is located between a platform and the cleaning hose conveyor module, and wherein the hose cleaner is arranged in such a way that when the cleaning hose is pulled out from the hose guide, the cleaning hose is first sprayed with the cleaning fluid via the nozzles and is then dried using the pneumatic blasting unit.

14. The method according to claim 13, wherein the pipe-shaped hose guide is rinsed with a gliding agent, before, while or after the cleaning hose is pushed into the hose guide.

* * * * *